United States Patent [19]

Aldea et al.

[11] 4,230,069

[45] Oct. 28, 1980

[54] PARTICLE FEED ARRANGEMENT FOR APPLYING SOLID PARTICLES TO THE IMAGE CARRIER OF A NON-IMPACT PRINTER

[75] Inventors: Jacques Aldea; Jean-Jacques Eltgen, both of Danjoutin; Gabriel Thiollier, Belfort, all of France

[73] Assignee: Compagnie Internationale pour l'Informatique CII-Honeywell Bull, Paris, France

[21] Appl. No.: 952,080

[22] Filed: Oct. 17, 1978

[30] Foreign Application Priority Data

May 16, 1978 [FR] France ..... 78 14363

[51] Int. Cl.[3] ..... G03G 21/00

[52] U.S. Cl. ..... 118/653; 346/74.1

[58] Field of Search ..... 346/74.1, 153, 155; 118/658, 652, 653; 355/3 DD

[56] References Cited

U.S. PATENT DOCUMENTS

| | | | |
|---|---|---|---|
| 2,826,168 | 3/1958 | Grant, Jr. | 346/153 X |
| 3,246,629 | 4/1966 | Shelffo | 118/658 |
| 3,951,542 | 4/1976 | Ito et al. | 355/3 DD |
| 4,011,835 | 3/1977 | Lewis | 118/652 |
| 4,054,381 | 10/1977 | Bernhard | 355/3 DD |
| 4,101,211 | 7/1978 | Kayson | 355/3 DD |

*Primary Examiner*—John H. Wolff

*Attorney, Agent, or Firm*—Kerkam, Stowell, Kondracki & Clarke

[57] ABSTRACT

A particle feed arrangement for applying solid particles contained in a particle storage tank to an image carrier of a non-impact printer. The arrangement includes a conveying member in the form of an endless screw conveyor disposed to pass within a particle supply source to feed the particles to the vicinity of a surface of the carrier. A deflector is interposed between the carrier and the conveying member to collect the particles conveyed by the member. The deflector has one of its edges arranged in the immediate vicinity of the said carrier to form, in conjunction with the carrier, a trough of generally prismatic shape in which the particles so collected accumulate. The other edge of the deflector, which is formed by a rectangular plate, is virtually in contact with the peripheral extremities of the endless screw to cause the particles to be collected in the trough. The carrier is movable in a direction in which it carries the particles towards the edge of the said prism which is spaced from the surface of the carrier to allow the particles which are carried past this edge to remain applied only to the sensitized zones of the said image carrier and excess unapplied particles to be returned to the supply source.

7 Claims, 4 Drawing Figures

PARTICLE FEED ARRANGEMENT FOR APPLYING SOLID PARTICLES TO THE IMAGE CARRIER OF A NON-IMPACT PRINTER

BACKGROUND OF THE INVENTION

1. Field of the Invention

The present invention relates to an improvement to the invention described in co-pending application Ser. No. 952,071 of Jean-Jacques Binder, filed Oct. 17, 1978, entitled "A Particle Feed Arrangement for Applying Solid Particles to the Image Carrier of a Non-Impact Printer" and corresponding to French patent application No. 77 31966, filed Oct. 24, 1977. It relates in particular to a solid particle conveying member, which conveys solid particles into the vicinity of the surface of an image carrier of a non-impact printer.

2. Description of the Prior Art

So called non-impact or strikeless transfer printing machines are known in which characters are printed without relying for this purpose on the impact of raised printing type against a recipient sheet of paper.

Printing machines of this kind generally have an image carrier which is usually formed by a rotary drum or an endless belt on the surface of which sensitized zones, also termed latent images, can be formed, by electrostatic or magnetic methods, which correspond to the characters or images to be printed. The latent images are then developed, that is to say, rendered visible, by means of a powder developing pigment which, when deposited on the image carrier, is only attracted by its sensitized zones. After this, the particles of pigment which have been deposited in this way on the latent images are transferred to a carrier sheet, such as a sheet of paper, for example, to which they are then permanently affixed.

In the prior art, various particle applicator arrangements have been used to apply the powdered developing pigment to the image carrier of a printing machine of this kind. For example, use has been made of an arrangement which incorporates a cylindrical casing containing the powdered pigment. This casing is provided with an opening across which the image carrier passes. The carrier is supplied with pigment by a cylindrical brush, which, as it rotates within the casing, throws particles of pigment onto the surface of the carrier as the latter passes across the opening. This arrangement is not entirely satisfactory in use owing, on the one hand, to the fact that it causes a cloud of pigment particles to be formed which spreads outside the casing, which is particularly unpleasant for people who, being near the printer, come into contact with the cloud, and on the other hand, to the fact that the particles become electrified in an undesirable way and, when thrown onto the carrier, are able to cling to the unsensitized zones of the carrier as a result of electrostatic attraction.

The particle applicator arrangement which is described in the aforenoted application for patent overcomes these disadvantages. That arrangement includes on the one hand, a conveying member which is arranged to feed the particles of pigment from a source tank into the vicinity of the surface of the carrier and on the other hand, a deflector interposed between the carrier and the conveying member to collect the particles conveyed by this member. The deflector has one of its edges arranged in the immediate vicinity of the said carrier in such a way as to form, in conjunction with the carrier, a trough substantially in the shape of a dihedral prism in which the particles so collected build up. Because of this, when the image carrier moves in the appropriate direction to carry the particles which have built up towards the edge of the trough, the particles which are carried past this edge remain applied only to the sensitized zones of the said image carrier and excess non-applied particles are returned to the source.

SUMMARY OF THE INVENTION

The present invention enables pigment particles to be properly applied to the image carrier of the printer and is an improvement over the aforenoted invention described and illustrated in Ser. No. 952,071. More particularly, it relates to a conveying member which ensures that the particles which build up in the trough are regularly distributed.

The present invention in its prefered embodiment includes an improved arrangement for applying solid particles contained in a tank to the image carrier of a non-impact printer. An endless screw conveying member is arranged to feed the particles into the vicinity of the surface of the carrier. The screw has its axis of rotation parallel to the axis of the image carrier and to the edge of a deflector interposed between the carrier and the conveying member to collect the particles conveyed by this member. The edge of the deflector is arranged in the immediate vicinity of the carrier in such a way as to form in conjunction with the carrier, a trough of generally prismatic shape and more particularly of a dihedral prism shape in which the collected particles build up. The image carrier is moved in a direction in which it carries the particles towards the edge of the prism, i.e. toward the build up of particles. The particles which are carried past this edge are applied only to the sensitized zones of the said image carrier and excess non-applied particles are returned to the tank.

BRIEF DESCRIPTION OF THE DRAWINGS

Other objects and advantages of the invention will become apparent from the following description, which is given by way of non-limiting example, and by reference to the accompanying drawings, in which.

DESCRIPTION OF THE PREFERRED EMBODIMENTS

Figure 1:
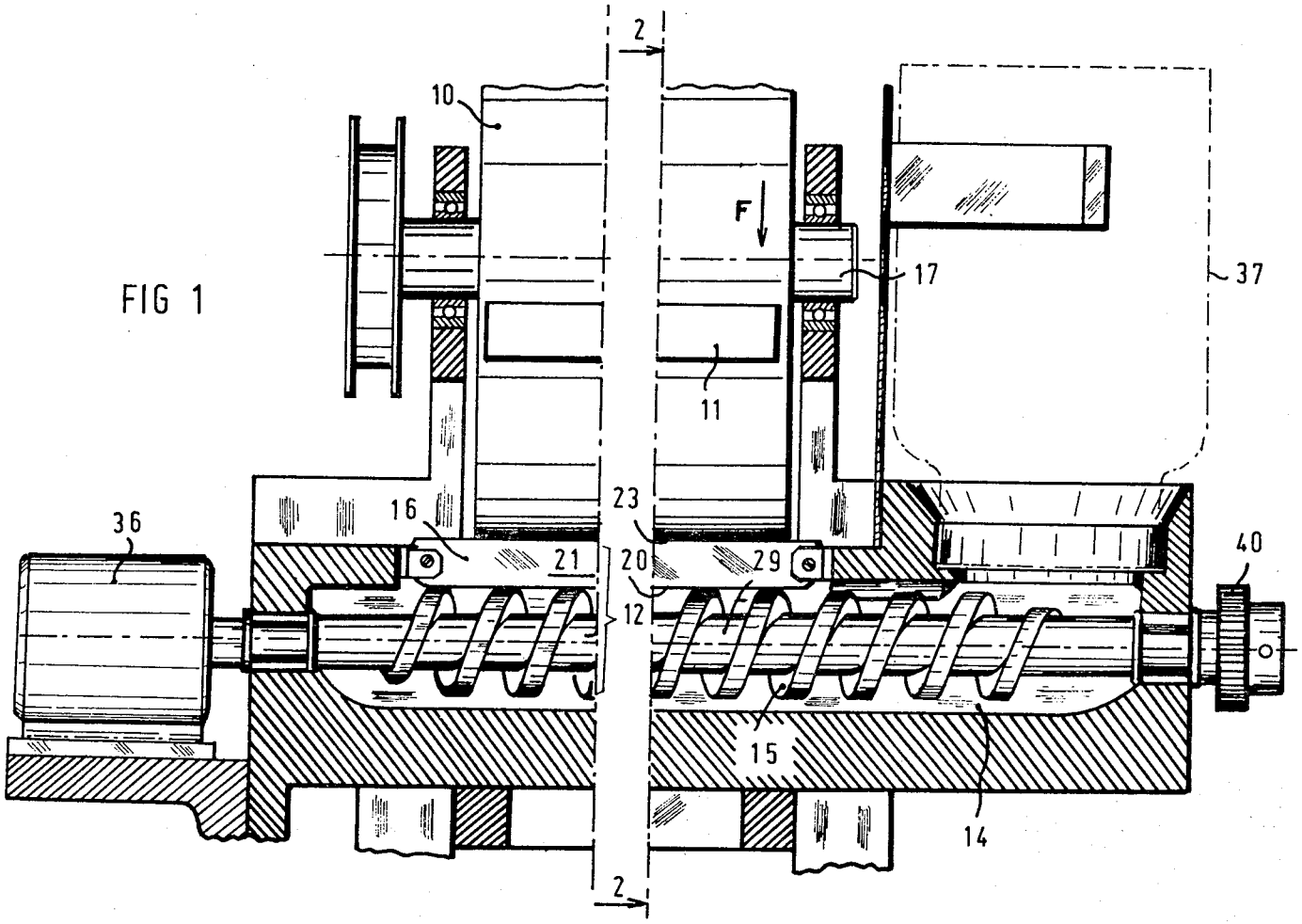
FIG. 1 is a general diagram of one arrangement constructed in accordance with the invention which is used to apply a powdered pigment to the image carrier of a non-contact printer machine.

The non-contact printing machine, of which part is shown diagrammatically in FIG. 1, is similar to that which was described and illustrated in the aforenoted application for patent Ser. No. 952,071 entitled "A Particle Feed Arrangement for Applying Solid Particles to the Image Carrier of a Non-Impact Printing Machine". The subject matter of said application is hereby incorporated by reference and reference may be made to this application for details of the construction of this machine.

Figure 2:
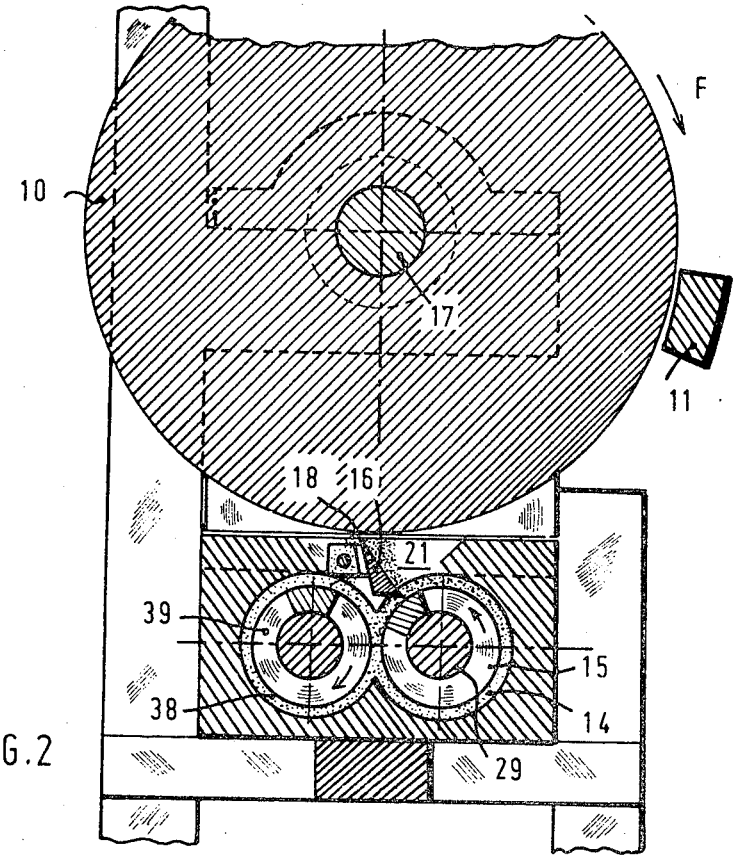
FIG. 2 is a cross-section of the arrangement shown in FIG. 1 taken on the chain line 2—2, looking in the direction of arrows.

Referring now to FIGS. 1 and 2 herein, it will be seen that the machine includes an image carrier which in the preferred embodiment is a magnetic drum 10. Drum 10 is rotatably driven in the direction of arrow F by an electric motor (not shown) drivingly connected to pulley 9 mounted at one end of shaft 17. Information is recorded on this drum by a magnetic recording member 11. In the preferred embodiment, member 11 is formed by an assembly consisting of a plurality of magnetic recording heads positioned side by side and aligned in a direction parallel to the axis of rotation of the shaft 17 on which the drum 10 rotates. When energized at various times by an electric current, each of these heads generates a varying magnetic field, the effect of which is to create magnetized or sensitized zones on the surface of the drum as it passes in front of the recording member 11. The times at which the heads are energized is determined in a known fashion in such a way as to produce on the surface of the drum, magnetized or sensitized zones, also termed latent images, whose shapes correspond to those of the characters to be printed. The magnetized zones on the drum then pass in front of an applicator arrangement 12 which is situated below the drum 10 and which enables particles of a powdered pigment contained in a tank 14 to be applied to the surface of the drum. In the preferred embodiment, this pigment is composed of magnetic particles coated with a resin which, when heated, is capable of melting and attaching itself to the paper on which it has been deposited.

As can be seen in FIG. 1, the applicator arrangement 12 includes a conveying member 15 in the form of a screw conveyor which picks up the particles of pigment situated in the tank 14 as shaft 29 is rotated and brings them into the vicinity of the surface of the drum 10. A fixed deflector 16 is disposed between the conveying member 15 and the drum 10 to collect the particles conveyed by member 15 and to apply them to the surface of the drum 10.

For details of the construction and positioning of the deflector 16 reference should be made to the aforenoted patent application, the subject matter of which has been incorporated by reference. It will simply be mentioned here that the deflector is formed in practice by a rectangular plate 16 whose longitudinal edges are parallel to the axis of rotation 17 of the drum 10. This plate is inclined with respect to the surface of the drum in such a way as to form with the drum 10 a trough 21 which is virtually in the form of a dihedral prism (or physical prism) whose edge 18 is formed by the intersection of the plane of the plate with the surface of the drum. It should also be noted that the deflector 16 is generally in contact, at its lower longitudinal edge 20 as shown in the drawing, with the conveying member 15, so that the particles of pigment which are carried along by the conveying member are arrested in passing by the deflector 16 and thus build up in the trough 21. The direction in which the magnetic drum 10 rotates, which is indicated by arrow F in FIGS. 1 and 2, is such that the particles which are collected in trough 21 are applied to the magnetized zones on the drum and are carried towards the edge 18 of the trough. The particles which are thus carried along by the drum 10 are not arrested in passing by the deflector 16 owing to the fact that the deflector is spaced slightly from the surface of the drum and thus leaves, between its upper longitudinal edge 23 and the drum, an opening of between 3/10ths of a millimeter to 1 millimeter. This width is sufficient to allow the particles of pigment which are carried along by the drum 10 to leave the trough 21. The particles of pigment which are applied to the magnetized zones of the drum and which leave the trough 21 continue to adhere to the magnetized zones and thus render visible the characters which are to be printed, while the particles which leave the trough 21 and which are not retained by the drum generally drop back into the tank 14.

In the preferred embodiment, which is illustrated in FIGS. 1 and 2, the conveying member 15 is formed by an endless screw whose axis of rotation established by shaft 29 is parallel to the edge 18 of the trough 21. Endless screw 15 is driven in rotation by an electric motor 36 and extends for virtually the entire length of the tank 10. As shown in FIG. 1, the tank 14 which contains a supply of pigment particles extends not only beneath the magnetic drum 10, but also beneath a receptacle 37 which, being positioned at the side of the drum 10 and containing a large supply of powdered pigment, is responsible for maintaining the supply of pigment in the tank 14. The direction of rotation of the endless screw 15 is effected in such a way that particles of pigments are forced along by the screw and move towards the opposite end of the tank 14 from the end situated below receptacle 37, that is to say, the particles move from right to left as viewed in FIG. 1.

Figure 4:
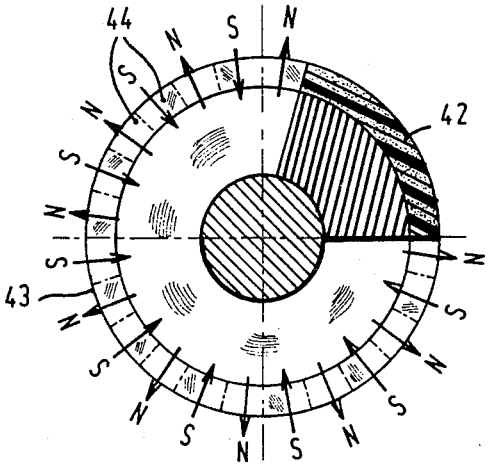
FIG. 4 is a view intended to show the manner in which the conveyor shown in FIG. 3 is magnetized.
Figure 3:
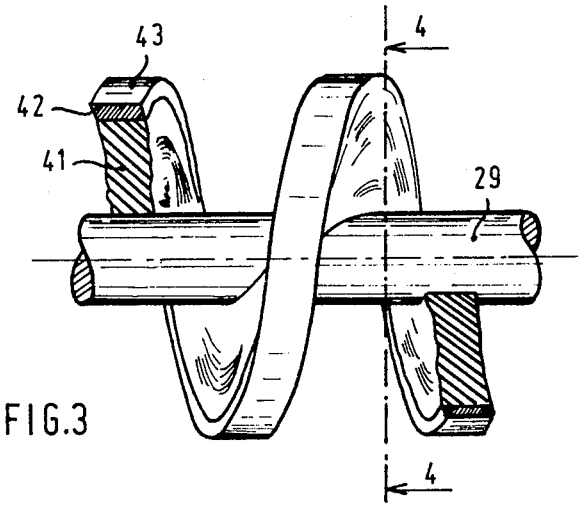
FIG. 3 is a view of a segment of a screw conveyor forming part of the arrangement shown in FIG. 1.

Referring now to FIG. 3, it can be seen that in the example being described where the pigment is formed by magnetic particles coated with meltable resin, the spiral part 41 of the endless screw 15 is covered with a permanently magnetized strip 42 of rubber having incorporated therein permanently magnetized metallic particles. FIG. 4 shows that the strip 42 has been magnetized in such a way as to have, on its outer face 43 (FIGS. 3 and 4), sucessive magnetized zones 44 whose polarity is such that any two consecutive zones of magnetization have opposite magnetic polarities. In other words, the polarity of these successive magnetized zones is alternately north and south, the north and south poles being marked with the letters N and S respectively in FIG. 4. Under these conditions, some of the pigment particles situated in that tank 14 are attracted by the strip 42. It should, however, be noted that the manner of magnetizing the strip 42 which has just been described is not a limitation on the invention, and any other manner of magnetization which would enable the strip 42 to attract the pigment particles could be utilized.

The particles which are attracted in this way apply themselves to the outer face 43 of the strip. As a result, when the endless screw 15 rotates, the particles adhering to the outer face are arrested in passing by the deflector 16 and thus build up in the trough 21. Advantageously, owing to the fact that the particles of pigment which adhere to the strip 42 form a relatively thick layer on the outer face 43, it is not necessary for the lower longitudinal edge 20 of the deflector 16 to be in contact with the strip, and it can be ensured that a large proportion of the particles are intercepted by the deflector 16 simply by positioning the lower longitudinal edge 20 in the immediate vicinity of the strip 42, and slightly spaced therefrom, thus minimizing the wear factor. It should also be noted that the deflector 16 being close to the strip 42 arrests the particles conveyed by the endless screw as they pass the deflector such that the successive zones of magnetization on the strip do not remain at fixed points. As the screw 15 turns, there is in fact a relative movement along the deflector 16 in the right to left direction in FIG. 1. This movement along the deflector 16 by the particle-intercepting zones makes it possible to achieve within the trough 21 a build-up of particles which is virtually the same along the entire length of the trough and improves still further the application of pigment to the magnetic drum 10.

The particle feed applicator arrangement which is illustrated in FIGS. 1 and 2 also includes, as shown in FIG. 2, a second endless screw 39 which extends below the upper edge 18 of the deflector 21 as viewed in the drawing. Screw 39 is positioned parallel to and adjacent endless screw 15 and is housed in a recycling passage 38. This passage 38, which is open at the top, communicates with the tank 14.

According to an alternate embodiment of the invention, passage 38 is separated from passage 14 by a partition (not shown) having a configuration adapted to suit the throughputs required, i.e. to allow the excess particles accumulating in passage 38 to be returned to tank 14. The second endless screw 39 is driven in rotation by the motor 36 via pinions of which one, 40, can be seen in FIG. 1 mounted on the shaft 29 of the endless screw 15. The function of the recycling passage 38 and the screw 39 is to return particles to the end of the tank 14 situated below the receptacle 37. The particles of pigment which make their way into passage 38, are either particles from the tank 14 which, having been unable to collect in the trough 21, finally escape from the tank as a result of the pressure exerted by the endless screw 15, or else particles which, having left the trough 21 and having not been retained by the magnetic drum 10, drop back either into passage 14 or into passage 38 as can be seen in FIG. 2.

The foregoing description is given by way of example and should not be construed to limit or restrict the invention in any way. Reference should be made to the appended claims which are intended to cover all technical equivalents which come within the true spirit and full scope of the invention.

We claim:

1. An apparatus for developing a latent image formed on the surface of an image carrier which is arranged for movement in a predetermined path, said apparatus comprising: a tank for containing a supply of attractable solid particles, first endless screw conveying means comprising a rotatable shaft having a spiral thread and being disposed in said tank so as to cause particles in said tank to be transported to the vicinity of a lowermost position in the path of said image carrier upon rotation of said shaft, a deflector interposed between said endless screw conveying means and said image carrier at said lowermost position, said deflector having two opposite parallel edges of which one is disposed in close proximity to the surface of said image carrier to form, in conjunction with the latter, a trough of generally prismatic shape, the other being disposed in contact with the spiral thread of said endless screw conveying means to cause particles conveyed by said screw conveying means to be collected and accumulated in said trough; and driving means for moving said image carrier in a direction in which it carries particles so accumulated towards said deflector edge which is in close proximity to the surface of said carrier, the distance between said deflector edge and said surface being higher than a first limiting value to allow particles which are carried by said image carrier not to be arrested by said deflector, and lower than a second limiting value in order to prevent the formation of a wave of particles.

2. An apparatus for developing a latent image formed on the surface of a drum adapted to rotate about its axis said apparatus comprising: a tank for containing a supply of attractable solid particles, said tank being disposed under said drum; endless screw conveying means comprising a rotatable shaft disposed in said tank and in a direction parallel to said axis and having a spiral thread positioned to come into contact with the particles in said tank to cause said particles, in the course of the rotation of said shaft, to be transported to the vicinity of the surface of said drum; a deflector interposed between said drum and said endless conveying means, said deflector having two opposite parallel edges of which one is disposed in close proximity to the surface of said drum to form, in conjunction with the latter, a trough of generally prismatic shape, the other edge being in contact with the spiral thread of said endless conveying means to cause particles conveyed by said means to be collected and accumulated in said trough; and driving means for moving said drum in a direction in which it carries particles so accumulated towards said deflector edge which is in close proximity to the surface of said drum, the distance between said deflector edge and said drum being higher than a first limiting value to allow particles which are carried by said drum not to be arrested by said deflector, and lower than a second limiting value in order to prevent the formation of a wave of particles.

3. A developing apparatus according to claim 2, wherein the endless screw means includes means disposed at one end of said tank for rotating said shaft, and the shaft extends between opposite ends of the tank, the direction of rotation of the shaft being one which causes particles of pigment to move towards the other end of said tank, the apparatus also including a second endless screw means comprising a rotatable shaft housed in a passage communicating with the tank, said shaft of said second screw means being arranged parallel to the shaft of the first endless screw means and adjacent thereto, and means for drawing said shaft of said second endless screw means in rotation in a direction such that it returns towards said one end of the tank particles which, having left the said tank, make their way into the said passage.

4. A developing apparatus according to claim 1 or 2, wherein the solid particles are capable of being attracted by a magnet, and the endless screw has a spiral portion covered by a permanently magnetized strip.

5. A developing apparatus according to claim 4, wherein the strip is magnetized in such a way as to have, on its outer face, successive zones of magnetization whose magnetic polarity is such that any two consecutive zones of magnetization are of opposite polarities.

6. A developing apparatus according to claim 5, wherein the endless screw means includes means disposed at one end of said tank for rotating said shaft, and the shaft extends between opposite ends of the tank, the direction of rotation of the shaft being one which causes particles of pigment to move towards the other end of said tank, the apparatus also including a second endless screw means comprising a rotatable shaft housed in a passage communicating with the tank, said shaft of said second screw means being arranged parallel to the shaft of the first endless screw means and adjacent thereto, and means for driving said shaft of said second endless screw means in a rotation in a direction such that it returns towards said one end of the tank particles which, having left the said tank, make their way into the said passage.

7. A developing apparatus according to claim 1 or 4, wherein the endless screw means includes means disposed at one end of said tank for rotating said shaft, and the shaft extends between opposite ends of the tank, the direction of rotation of the shaft being one which causes particles of pigment to move towards the other end of said tank, the apparatus also including a second endless screw means comprising a rotatable shaft housed in a passage communicating with the tank, said shaft of said second screw means being arranged parallel to the shaft of the first endless screw means and adjacent thereto, and means for driving said shaft of said second endless screw means in a rotation in a direction such that it returns towards said one end of the tank particles which, having left the said tank, make their way into the said passage.

* * * * *